US009200574B2

(12) United States Patent
Kim et al.

(10) Patent No.: US 9,200,574 B2
(45) Date of Patent: Dec. 1, 2015

(54) VARIABLE VALVE TIMING APPARATUS

(71) Applicant: HYUNDAI HEAVY INDUSTRIES CO., LTD., Ulsan (KR)

(72) Inventors: Seho Kim, Ulsan (KR); Dongyeon Kim, Ulsan (KR); Sunghyeok Kim, Ulsan (KR); Hunsuk Kim, Ulsan (KR)

(73) Assignee: HYUNDAI HEAVY INDUSTRIES CO., LTD., Ulsan (KR)

( * ) Notice: Subject to any disclaimer, the term of this patent is extended or adjusted under 35 U.S.C. 154(b) by 127 days.

(21) Appl. No.: 14/056,201

(22) Filed: Oct. 17, 2013

(65) Prior Publication Data

US 2014/0109849 A1 Apr. 24, 2014

(30) Foreign Application Priority Data

Oct. 19, 2012 (KR) ..... 10-2012-0116691

(51) Int. Cl.

| | |
|---|---|
| ***F01L 1/34*** | (2006.01) |
| ***F02D 13/02*** | (2006.01) |
| ***F01L 9/02*** | (2006.01) |
| ***F01L 13/00*** | (2006.01) |

(52) U.S. Cl.

CPC ..... *F02D 13/02* (2013.01); *F01L 9/021* (2013.01); *F01L 13/0031* (2013.01)

(58) Field of Classification Search

CPC ..... F01L 1/255; F01L 1/245; F01L 2001/256; F01L 9/02; F01L 9/025; F01L 9/023; F01L 9/021

See application file for complete search history.

(56) References Cited

U.S. PATENT DOCUMENTS

2009/0320780 A1 * 12/2009 Sundsten et al. ..... 123/90.55

FOREIGN PATENT DOCUMENTS

| | | | |
|---|---|---|---|
| JP | 2012-41901 A | | 3/2012 |
| JP | 2012-62787 A | | 3/2012 |
| KR | 1020020015825 A | | 3/2002 |
| WO | WO 2010049583 A1 | * | 5/2010 |
| WO | WO 2010125235 A1 | * | 11/2010 |
| WO | WO 2011004059 A1 | * | 1/2011 |

* cited by examiner

*Primary Examiner* — Jesse Bogue
*Assistant Examiner* — Daniel Bernstein
(74) *Attorney, Agent, or Firm* — RatnerPrestia

(57) ABSTRACT

A variable valve timing apparatus including: an actuator housing having a space at the inside thereof; an upper plunger mounted inside the upper portion of the actuator housing to move upward and downward; a lower plunger mounted inside the lower portion of the actuator housing to allow the upper plunger to move upward and downward; an oil chamber allows oil to be circulated upwardly and downwardly or blocks the flow of oil through a head formed on the top end periphery of the upper plunger in accordance with the upward and downward movements of the upper plunger; and a communicating passage allows the upper and lower end portions of the oil chamber to communicate with each other in accordance with upward and downward movements of the lower plunger and to adjust the oil flowing thereon to control the speeds of the upward and downward movements of the upper plunger.

8 Claims, 8 Drawing Sheets

VARIABLE VALVE TIMING APPARATUS

BACKGROUND OF THE INVENTION

1. Field of the Invention

The present invention relates to a valve timing apparatus that is capable of controlling the timing of the opening and closing of the intake and exhaust valves in an engine, and more particularly, to a variable valve timing apparatus that is capable of adjusting the speeds upon upward and downward movements of upper and lower plungers through oil circulation to control the timing of the opening and closing of the intake and exhaust valves in an engine.

2. Background of the Related Art

Recently, the demand for eco-friendly, high efficiency engines has been increased, so that various improvements in the performance of the engines are provided, and further, optimal parts as well as control technologies capable of ensuring high efficiency in engines have been made and developed.

So as to improve the performance of engines, especially, intake and exhaust conditions should be optimized, and accordingly, various technologies have been proposed to optimize the timing of the opening and closing of intake and exhaust valves in the engine through the adjustment of the different timing of the valves caused by the operating speed of the engine.

Like this, the timing of the opening and closing of the intake and exhaust valves is varied in accordance with the operating speed and load of the engine, thereby optimizing the heat efficiency and output of the engine and improving the fuel efficiency. The above-mentioned technology is applied to a variable valve timing apparatus of an engine.

The variable valve timing apparatus generally advances or retards the timing of the opening of the valves through the variation of the phase of a cam. In the existing engines, the control of the timing of the opening and closing of the valves is conducted by using a combustion driving system through a cam profile having fixed mechanical valve timing.

In case of the conventional variable valve timing apparatus, however, it is impossible to vary the timing of the opening and closing of the valves during the operation of the engine unless the cam is changed, and further, a helical gear type, a torsional spline type, a vane type, or an electro-hydraulic type cam phase varying mechanism should be mounted on the front end portion of the camshaft, thereby making the configuration very complicated and also making the size of a cylinder head portion bulky.

In case of another conventional variable valve timing apparatus, a valve lift mechanism is changed in configuration to vary the opening keeping time of the valves or the timing of the opening and closing timing of the valves, thereby unfortunately making the configuration very complicated and also making the volume of a cylinder head portion bulky.

SUMMARY OF THE INVENTION

Accordingly, the present invention has been made in view of the above-mentioned problems occurring in the prior art, and an aspect of the present invention provides a variable valve timing apparatus that is capable of circulating oil in accordance with the upward and downward movements of upper and lower plungers, thereby controlling the timing of the opening and closing of intake and exhaust valves through the control of the speeds of the upward and downward movements of the upper and lower plungers to improve the efficiency and output of an engine.

To accomplish this, according to the present invention, there is provided a variable valve timing apparatus including: an actuator housing having a given space portion at the inside thereof; an upper plunger insertedly mounted inside the upper portion of the actuator housing in such a manner as to move upward and downward; a lower plunger insertedly mounted inside the lower portion of the actuator housing in such a manner as to allow the upper plunger to move upward and downward; an oil chamber formed to allow oil to be circulated upwardly and downwardly or to allow the flow of oil to be blocked through a head formed on the top end periphery of the upper plunger in accordance with the upward and downward movements of the upper plunger; and a communicating passage portion adapted to allow the upper and lower end portions of the oil chamber to communicate with each other in accordance with the upward and downward movements of the lower plunger and to adjust the flow of oil flowing thereon to control the speeds of the upward and downward movements of the upper plunger.

According to the present invention, desirably, the oil chamber includes: an upper chamber formed on the upper side portion of the upper plunger; a damping chamber formed on the outer peripheral surface of a body of the upper plunger in such a manner as to communicate with the lower side portion of the upper chamber or to be blocked therefrom in accordance with the upward and downward movements of the upper plunger; and a circulating passage adapted to allow the upper chamber and the damping chamber to communicate with each other and having an opening and closing valve mounted thereon to restrict oil movement.

According to the present invention, desirably, the circulating passage includes an oil injector disposed below the opening and closing valve, the oil injector having a check valve mounted thereon to inject oil to the circulating passage.

According to the present invention, desirably, the damping chamber includes an auxiliary plunger adapted to elastically support the head formed on the top end periphery of the upper plunger and an oil accommodating portion formed between the outer peripheral surface of the upper plunger and the inner peripheral surface of the auxiliary plunger, the auxiliary plunger being adapted to connect or block the oil accommodating portion with or from the circulating passage in accordance with the upward and downward movements of the upper plunger.

According to the present invention, desirably, the communicating passage portion includes: a first passage connected to the lower portion of the circulating passage; a second passage connected to the upper end of the upper chamber; and a connecting passage formed along the outer peripheral surface of the upper end portion of the lower plunger to allow the volume of the communication between the first passage and the second passage to be varied in accordance with the location of the lower plunger.

According to the present invention, desirably, the lower plunger has a shim plate mounted on the underside thereof so as to adjust the initial position thereof.

BRIEF DESCRIPTION OF THE DRAWINGS

The above and other aspects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, an explanation on a variable valve timing apparatus according to aspects of the present invention will be in detail given with reference to the attached drawing.

Figure 1:
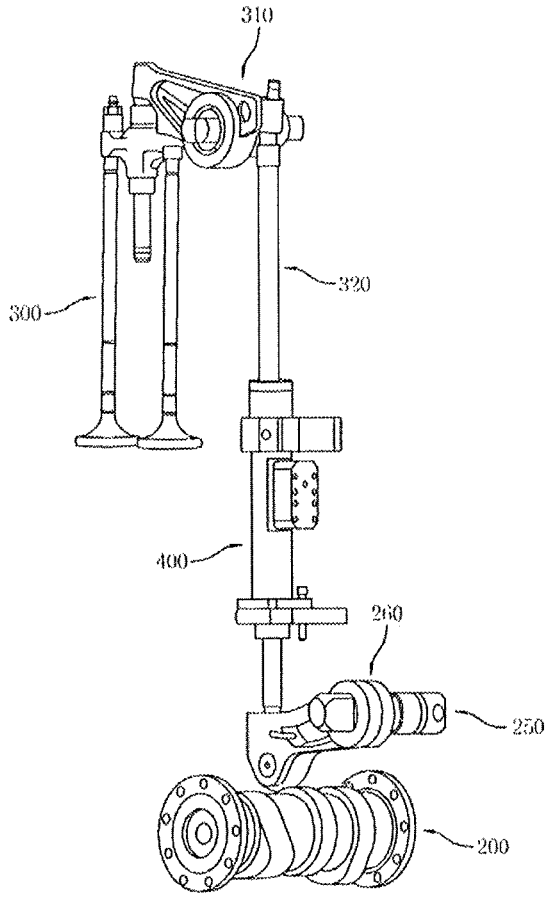
FIG. 1 is a perspective view showing a general intake and exhaust system having a variable valve timing apparatus mounted thereon.

FIG. 1 is a perspective view showing a general intake and exhaust system having a variable valve timing apparatus mounted thereon.

As shown, a variable valve timing apparatus 400 has a given length and is disposed between a pushrod 320 and a swing arm 250.

The swing arm 250 is cooperatively operated with a camshaft 200 and moves upward and downward, thereby allowing upper and lower plungers 20 and 30 (see FIG. 3) to move upward and downward, and at this time, the upper plunger 20 pressurizes the pushrod 320 to permit intake and exhaust valves 300 to be operated through a locker arm 310.

Hereinafter, an explanation on a variable valve timing apparatus according to the present invention will be in detail given with reference to FIGS. 2 to 6.

Figure 2:
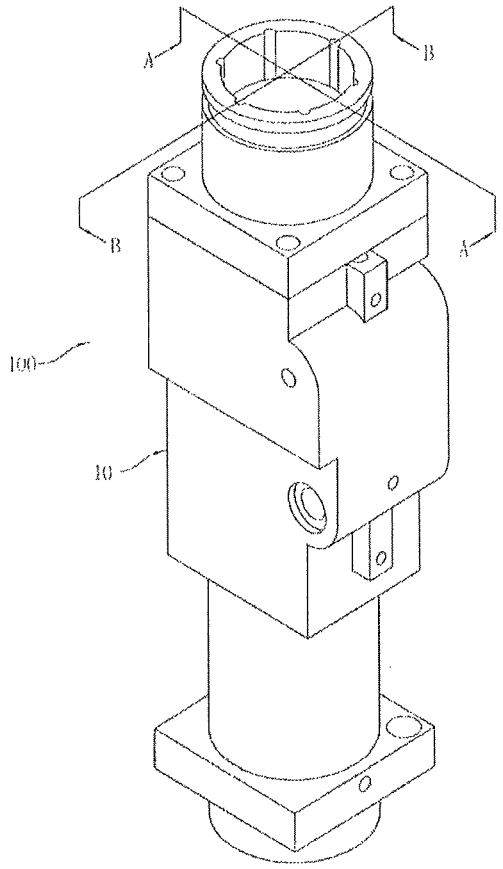
FIG. 2 is a perspective view showing a variable valve timing apparatus according to the present invention.
Figure 3:
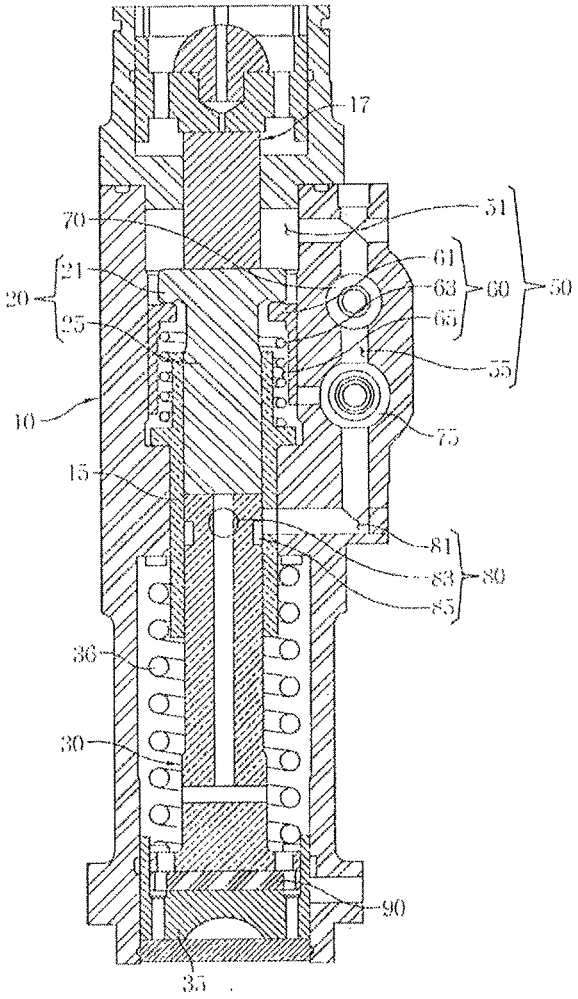
FIG. 3 is a sectional view taken along the line A-A of FIG. 2.
Figure 4:
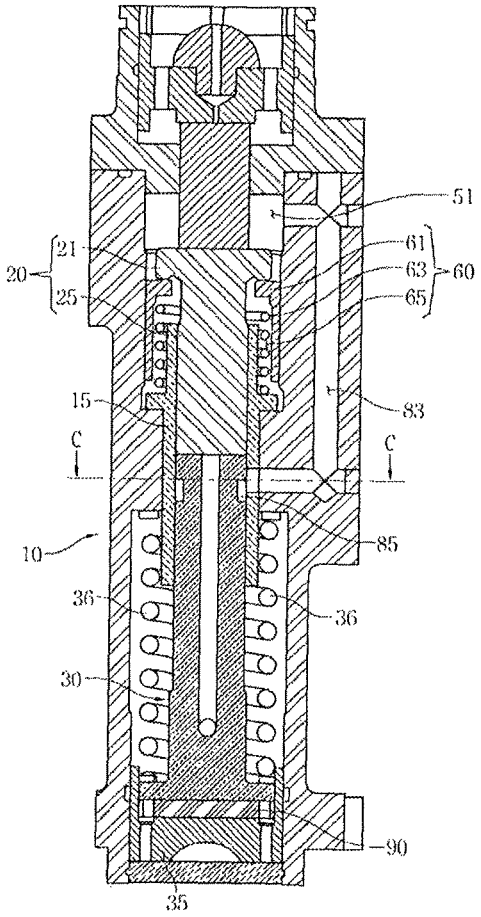
FIG. 4 is a sectional view taken along the line B-B of FIG. 2.
Figure 5:
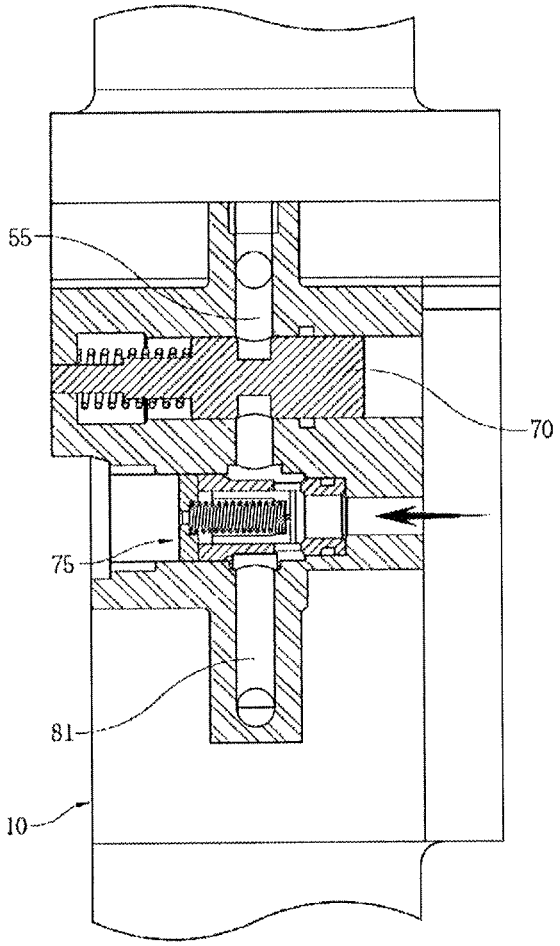
FIG. 5 is a sectional view showing a circulating passage formed in the variable valve timing apparatus according to the present invention.
Figure 6:
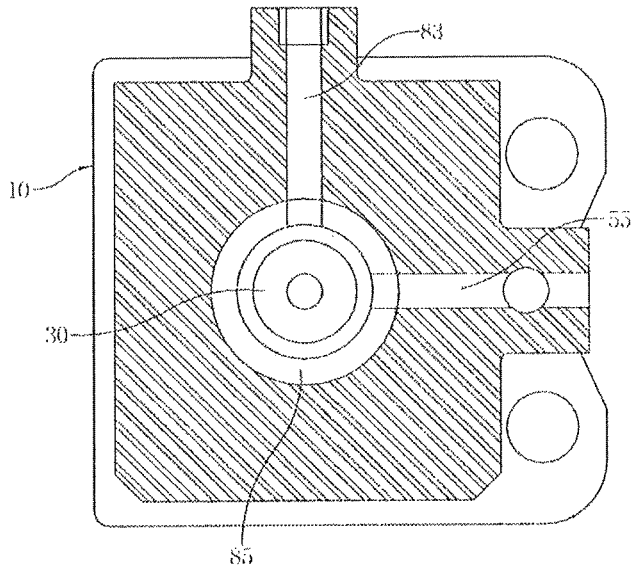
FIG. 6 is a sectional view taken along the line C-C of FIG. 4.

FIG. 2 is a perspective view showing a variable valve timing apparatus according to the present invention, FIG. 3 is a sectional view taken along the line A-A of FIG. 2, FIG. 4 is a sectional view taken along the line B-B of FIG. 2, FIG. 5 is a sectional view showing a circulating passage formed in the variable valve timing apparatus according to the present invention, and FIG. 6 is a sectional view taken along the line C-C of FIG. 4.

As shown, a variable valve timing apparatus 100 according to the present invention has a given length and includes an actuator housing 10, the upper plunger 20, the lower plunger 30, an oil chamber 50, and a communicating passage portion 80.

The actuator housing 10 has a given length and forms a given space portion at the inside thereof, in which the upper plunger 20 and the lower plunger 30 as will be described later move upward and downward.

On the other hand, the upper plunger 20 is insertedly mounted into the upper portion of the actuator housing 10 in such a manner as to slide in upward and downward directions.

In this case, the upper plunger 20 allows a pushrod connector 17 mounted on the inner periphery of the top end portion of the actuator housing 10 to move upward, so that the pushrod 320 is pressurized to operate the intake and exhaust valves 300.

Further, the upper plunger 20 includes a head 21 and a body 25 having a relatively smaller diameter than the head 21, thereby being formed of a 'T'-shaped cylinder, and in the state where the outer peripheral surface of the body 25 is brought into close contact with the inner peripheral surface of a hollow guide member 15 mounted inside the actuator housing 10, the body 25 slides.

On the other hand, the lower plunger 30 is cooperatively operated with the swing arm 250 to permit the upper plunger 20 to be moved upwardly, and it is slidably inserted into the lower portion of the actuator housing 10, while the top of the lower plunger 30 being brought into close contact with the underside of the upper plunger 20 on the same line as the upper plunger 20.

Accordingly, the lower plunger 20 moves upward and downward in accordance with the operation of the swing arm 250.

On the other hand, a spring 36 is mounted inside the actuator housing 10 to elastically support the lower plunger 30, and a lower support 35 is coupled to the lower end portion of the actuator housing 10 to support the lower plunger 30 and at the same time to transmit the operation of the swing arm 250 to the lower plunger 30.

In this case, the lower support 35 slides upward and downward in accordance with the operation of the swing arm 250, thereby moving the lower plunger 30 upward and downward.

On the other hand, the oil chamber 50 allows oil to be circulated in response to the upward and downward movements of the upper plunger 20 and includes an upper chamber 51, a damping chamber 60 and a circulating passage 55.

In this case, the upper chamber 51 is a given space portion formed on the upper plunger 20, and the damping chamber 60 is a given space portion formed between the outer peripheral surface of the body 25 of the upper plunger 20 and the inner peripheral surface of the actuator housing 10.

In this case, the circulating passage 55 serves to allow the upper chamber 51 to communicate with the damping chamber 60.

On the other hand, the damping chamber 60 includes an auxiliary plunger 61 and an oil accommodating portion 65.

The auxiliary plunger 61 moves upward and downward at the inside of the actuator housing 10 in such a manner as to be elastically supported against a spring 63 and is empty in the interior thereof in such a manner as to form the oil accommodating portion 65 therein. Further, the auxiliary plunger 61 is open at the top and bottom ends thereof, and through the center of the top end of the auxiliary plunger 61, the upper plunger 20 is passed.

Accordingly, the auxiliary plunger 61 has a shape of a cap having an opening formed at the center of the top side thereof and is brought into contact with the underside of the head 21 of the upper plunger 20 at the top end thereof in the state of being elastically supported against the spring 63, thereby elastically supporting the upper plunger 20.

At this time, the oil accommodating portion 65 is formed between the outer peripheral surface df the body 25 of the upper plunger 20 and the inner peripheral surface of the auxiliary plunger 61.

In this case, oil is charged into the upper chamber 51, the oil accommodating portion 65 and the circulating passage 55.

Further, the auxiliary plunger 61 moves upward and downward through the cooperative operation with the upward and downward movements of the upper plunger 20, and as shown in FIG. 3, the auxiliary plunger 61 opens and closes the end of the lower side of the circulating passage 55 formed vertically at the side of the actuator housing 10, thereby allowing the circulating passage 55 and the oil accommodating portion 65 to communicate with each other or to be blocked from each other.

On the other hand, as shown in FIG. 3, the circulating passage 55 is reverse '⊏'-shaped and formed in such a manner as to allow the top end opening and the lower end opening thereof to correspondingly communicate with the upper chamber 51 and the oil accommodating portion 65.

At this time, an opening and closing valve 70 is mounted on the circulating passage 55 so as to restrict the oil movement, and an oil injector 75 with a check valve mounted thereon is disposed below the opening and closing valve 70.

In this case, as shown in FIG. 5, the opening and closing valve 70 is elastically supported against a spring in such a manner as to open and close the passage of the oil, which is formed of a solenoid valve, and the check valve is mounted to inject the oil to the circulating passage 55 in such a manner as to form a passage along the outer periphery thereof, so that the oil is circulated along the circulating passage 55, the oil accommodating portion 65 and the communicating passage portion 80 as will be discussed later.

On the other hand, the communicating passage portion 80 is formed in such a manner as to allow the circulating passage 55 to communicate with the upper chamber 51 in another direction. That is, the communicating passage portion 80 allows the circulating passage 55 to communicate with the upper chamber 51 in correspondence with the upward and downward movements of the lower plunger 30, while adjusting the flow of oil flowing on the circulating passage 55 and the upper chamber 51 communicating with each other so as to control the speeds of the upward and downward movements of the upper plunger 20.

That is, the communicating passage portion 80 varies the flow of oil flowing on the circulating passage 55 and the upper chamber 51 communicating with each other to permit the load applied to the upper plunger 20 through the oil to be varied, thereby controlling the speeds of the upward and downward movements of the upper plunger 20.

In this case, the communicating passage portion 80 includes a first passage 81, a second passage 83, and a connecting passage 85.

The first passage 81 is connected to a check valve mounting portion of the oil injector 75 located on the circulating passage 55, and as shown in FIGS. 4 and 6, the second passage 83 is connected to the upper chamber 51 of the oil chamber 50 in another direction.

On the other hand, the connecting passage 85 is formed along the outer peripheral surface of the upper end portion of the lower plunger 30 and allows the first passage 81 and the second passage 83 to communicate with each other in accordance with the location of the lower plunger 30.

In this case, oil is charged into the upper chamber 51, the oil accommodating portion 65, the circulating passage 55, the first passage 81, the second passage 83 and the connecting passage 85 and circulatedly moves in accordance with the upward and downward movements of the upper plunger 20.

At this time, just oil leaking to the outside in accordance with the operations of the upper and lower plungers 20 and 30 is compensated through the oil injector 75.

On the other hand, a shim plate 90 of a given thickness is mounted between the underside of the lower plunger 30 and the lower support 35.

The shim plate 90 serves to adjust the initial position of the lower plunger 30 to arbitrarily control the timing of the opening and closing of the intake and exhaust valves 300.

Hereinafter, an operation of the variable valve timing apparatus according to the present invention will be in detail explained with reference to FIGS. 3 to 8.

Figure 7:
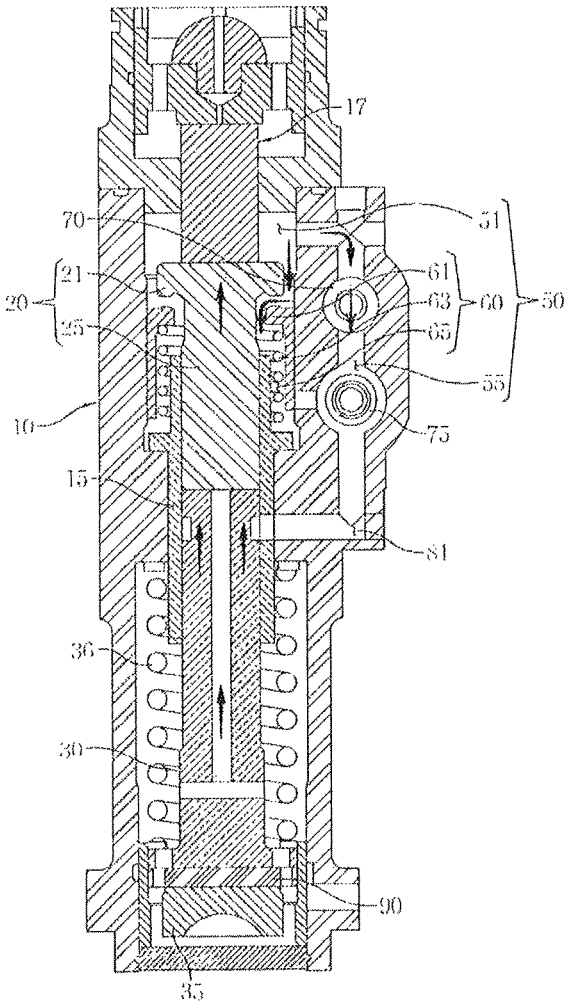
FIG. 7 is a sectional view showing the flow of oil upon the upward movements of the upper and lower plungers of the variable valve timing apparatus according to the present invention.
Figure 8:
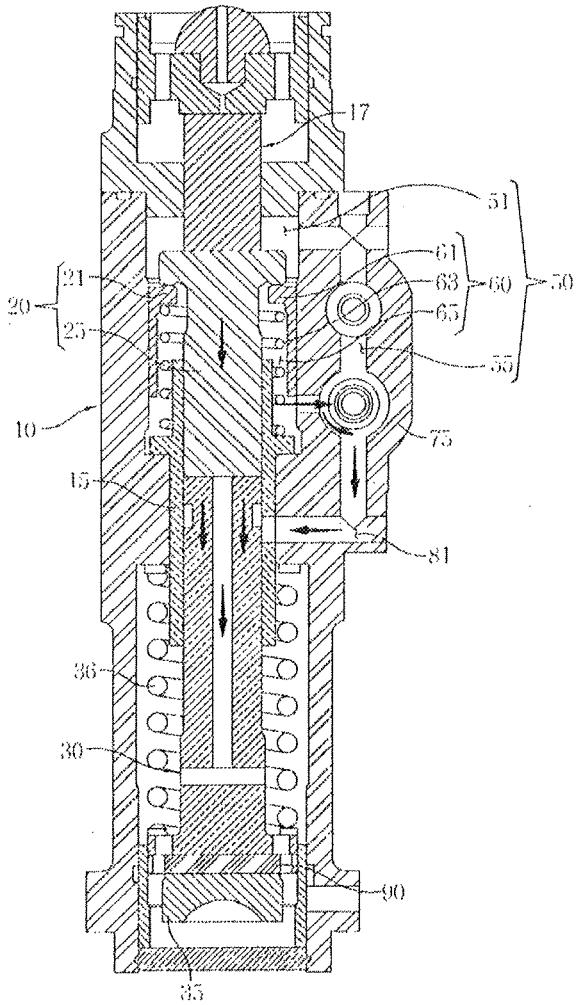
FIG. 8 is a sectional view showing the flow of oil upon the downward movements of the upper and lower plungers of the variable valve timing apparatus according to the present invention.

FIG. 7 is a sectional view showing the flow of oil upon the upward movements of the upper and lower plungers of the variable valve timing apparatus according to the present invention, and FIG. 8 is a sectional view showing the flow of oil upon the downward movements of the upper and lower plungers of the variable valve timing apparatus according to the present invention.

First, as shown in FIGS. 3 and 4, the auxiliary plunger 61 blocks the oil accommodating portion 65 and the circulating passage 55 in the state where the upper plunger 20 and the lower plunger 30 are located at their lowest ends, and at this time, a portion of the upper periphery of the connecting passage 85 of the communicating passage portion 80 is located at the position where the first passage 81 and the second passage 83 communicate with each other.

In this state, the intake and exhaust valves 300 maintain the state where a combustion chamber is closed.

After that, if the lower plunger 30 moves upward in accordance with the operations of the camshaft 200 and the swing arm 250, the upper plunger 20 moves upward to pressurize the pushrod 320, and at this time, the pushrod 320 pushes the intake and exhaust valves 300 through the locker arm 310, thereby performing the intake and exhaust operations in the combustion chamber.

At this time, if the upper plunger 20 moves upward, as shown in FIG. 7, the upper chamber 51 becomes decreased in volume, and accordingly, the oil existing in the upper chamber 51 moves to the opening and closing valve 70 and at the same time pressurizes the upper portion of the auxiliary plunger 61 as the arrows shown in FIG. 7.

That is, since the oil is charged in the oil chamber 50, a portion of the oil charged in the upper chamber 51 pressurizes the top of the auxiliary plunger 61, so that the underside of the head 21 of the upper plunger 20 is separated from the top of the auxiliary plunger 61, thereby allowing the oil to move to the oil accommodating portion 65.

In this case, since the opening and closing valve 70 maintains the open state, the oil moves downward along the circulating passage 55 and further moves to the oil accommodating portion 65, so that the auxiliary plunger 61 gradually moves upward by means of the elastic force of the spring 63 to permit the lower side end of the circulating passage 55 to be gradually open, thereby allowing the circulating passage 55 and the oil accommodating portion 65 to communicate with each other.

Accordingly, the oil in the upper chamber 51 flows into the oil chamber 50.

At this time, if the upper plunger 20 is located at the uppermost end position thereof to cause the flow of oil to disappear, the top of the auxiliary plunger 61 is brought into close contact with the underside of the head 21 of the upper plunger 20 again, and at the same time, the lower side end of the circulating passage 55 is completely open to allow the oil accommodating portion 65 and the circulating passage 55 to communicate with each other.

In this case, if the lower plunger 30 moves upward and is located at the uppermost end position thereof, as shown in FIG. 8, the connecting passage 85 of the communicating passage portion 80 is located above the first passage 81 and the second passage 83.

On the other hand, if the swing arm 250 moves downward by the rotation of the camshaft 200, the upper plunger 20 and the lower plunger 30 move downward through the cooperative operation with the swing arm 250.

The upper plunger 20 moves downward from the position as shown in FIG. 8, and the underside of the head 21 moves the auxiliary plunger 61 downward.

At this time, the opening and closing valve 70 mounted on the circulating passage 55 is turned 'OFF' to block the upward and downward movements of the oil.

Accordingly, the oil accommodating portion 65 becomes decreased in volume through the downward movements of the upper plunger 20 and the auxiliary plunger 61, so that the oil in the oil accommodating portion 65 is pushed toward the circulating passage 55 until the lower side opening of the circulating passage 55 is completely blocked by means of the auxiliary plunger 61.

At this time, the oil moving to the circulating passage 55 does not move upward to the circulating passage 65 by means of the opening and closing valve 70, but moves downward to the first passage 81.

Accordingly, the oil in the oil accommodating portion 65 moves to the first passage 81 until the lower side opening of the circulating passage 55 is completely blocked by means of the auxiliary plunger 61 and then moves to the upper chamber 51 via the connecting passage 85 and the second passage 83.

On the other hand, as shown in FIG. 8, if the lower plunger 30 is located at the uppermost end position thereof, the volume of the connecting passage 85 for allowing the first passage 81 and the second passage 83 to communicate with each other is reduced, thereby applying load to the movement of the oil, so that the speed of the downward movement of the upper plunger 20 is decreased and at the same time a damping operation is conducted.

However, if the communication volume of the connecting passage 85 is increased through the downward movement of the lower plunger 30, the speed of the downward movement of the lower plunger 30 is gradually increased.

On the other hand, if the connecting passage 85 is sufficiently moved downward, as shown in FIG. 4, the lower periphery of the connecting passage 85 is escaped from the lower ends of the first passage 81 and the second passage 83 again, so that the volume of the connecting passage 85 for allowing the first passage 81 and the second passage 83 to communicate with each other is decreased again, thereby making the speed of the downward movement of the upper plunger 20 gradually reduced.

The connecting passage 85 is gradually increased and then decreased again in volume for allowing the first passage 81 and the second passage 83 to communicate with each other through the downward movement thereof, and accordingly, the flow of oil is gradually increased and then decreased again. As a result, the speed of the downward movement of the upper plunger 20 is gradually increased at the initial position thereof and then decreased and stopped again through the load caused by the flow of oil.

Through the variations of the flow of oil, the load is applied to the flow of oil at the initial and final positions of the lower plunger 30 upon the downward movement of the lower plunger 30, thereby making the rapid downward movement of the upper plunger 20 restricted to provide the damping operation.

Accordingly, the load caused from the oil is applied to the downward movement of the upper plunger 20 to allow the time of the downward movement of the upper plunger 20 to be delayed, and thus, the closing time of the intake valve 300, for example, is extended to increase a quantity of air intake.

In this case, the time of the downward movement of the upper plunger 20 can be adjusted in accordance with the relative position of the connecting passage 85.

The above-mentioned operation is also performed upon the upward movements of the upper plunger 20 and the lower plunger 30, in the same manner as above.

Further, if the shim plate 90 of the given thickness is insertedly mounted on the underside of the lower plunger 30, the initial position of the lower plunger 30 is adjusted in accordance with the thickness of the shim plate 90, thereby allowing the timing of the opening and closing of the intake and exhaust valves 300 to be arbitrarily controlled.

Accordingly, the speeds of the upward and downward movements of the upper plunger 20 and the lower plunger 30 are delayed and at the same time the damping operations are performed at the initial and final positions of the upper plunger 20 and the lower plunger 30. Further, the selective application of the shim plate 90 arbitrarily adjusts the timing of the opening and closing of the intake and exhaust valves 300, thereby ensuring the timing of the valve opening and closing capable of providing the optimum conditions and thus improving the efficiency of the engine.

As mentioned above, the variable valve timing apparatus according to the present invention is capable of conveniently controlling the timing of the opening and closing of the intake and exhaust valves through the flow of circulating oil, thereby improving the efficiency and output of the engine and minimizing the quantity of smoke being generated to reduce the environmental contamination and further capable of arbitrarily controlling the timing of the opening and closing of the intake and exhaust valves, thereby improving the degree of freedom of design.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A variable valve timing apparatus comprising:

an actuator housing having a given space portion at an inside thereof;

an upper plunger insertedly mounted inside an upper portion of the actuator housing in such a manner as to move upward and downward;

a lower plunger insertedly mounted inside a lower portion of the actuator housing in such a manner as to allow the upper plunger to move upward and downward;

an oil chamber formed to allow oil to be circulated upwardly and downwardly or to allow the flow of oil to be blocked through a head formed on a top end periphery of the upper plunger in accordance with the upward and downward movements of the upper plunger; and a communicating passage portion adapted to allow the upper and lower end portions of the oil chamber to communicate with each other in accordance with the upward and downward movements of the lower plunger and to adjust the flow of oil flowing thereon to control the speeds of the upward and downward movements of the upper plunger, wherein the oil chamber comprises:

an upper chamber formed on the upper side portion of the upper plunger;

a damping chamber formed on an outer peripheral surface of a body of the upper plunger in such a manner as to communicate with the lower side portion of the upper chamber or to be blocked therefrom in accordance with the upward and downward movements of the upper plunger; and a circulating passage adapted to allow the upper chamber and the damping chamber to communicate with each other and having an opening and closing valve mounted thereon to restrict oil movement.

2. The variable valve timing apparatus according to claim 1, wherein the circulating passage comprises an oil injector disposed below the opening and closing valve, the oil injector having a check valve mounted thereon to inject oil to the circulating passage.

3. The variable valve timing apparatus according to claim 2, wherein the lower plunger has a shim plate mounted on the underside thereof so as to adjust the initial position thereof.

4. The variable valve timing apparatus according to claim 1, wherein the damping chamber comprises:

an auxiliary plunger adapted to elastically support the head formed on the top end periphery of the upper plunger; and an oil accommodating portion formed between the outer peripheral surface of the upper plunger and the inner peripheral surface of the auxiliary plunger, the auxiliary plunger being adapted to connect or block the oil accommodating portion with or from the circulating passage in accordance with the upward and downward movements of the upper plunger.

5. The variable valve timing apparatus according to claim 4, wherein the lower plunger has a shim plate mounted on the underside thereof so as to adjust the initial position thereof.

6. The variable valve timing apparatus according to claim 1, wherein the communicating passage portion comprises:

a first passage connected to the lower portion of the circulating passage;

a second passage connected to the upper end of the upper chamber; and a connecting passage formed along the outer peripheral surface of the upper end portion of the lower plunger to allow the volume of the communication between the first passage and the second passage to be varied in accordance with the location of the lower plunger.

7. The variable valve timing apparatus according to claim 6, wherein the lower plunger has a shim plate mounted on the underside thereof so as to adjust the initial position thereof.

8. The variable valve timing apparatus according to claim 1, wherein the lower plunger has a shim plate mounted on the underside thereof so as to adjust the initial position thereof.

* * * * *